US006253845B1

(12) United States Patent
Belik

(10) Patent No.: US 6,253,845 B1
(45) Date of Patent: Jul. 3, 2001

(54) ROLLER FOR USE IN A SPINNER APPARATUS

(76) Inventor: Jaroslav Belik, 4955 Sentry Woods La., Pearland, TX (US) 77584

( * ) Notice: Subject to any disclaimer, the term of this patent is extended or adjusted under 35 U.S.C. 154(b) by 0 days.

(21) Appl. No.: 09/458,203

(22) Filed: Dec. 10, 1999

(51) Int. Cl.[7] ..... E21B 19/16; E25B 17/00

(52) U.S. Cl. ..... 166/77.51; 166/78.1; 81/57.16

(58) Field of Search ..... 166/78.1, 85.1, 166/77.51; 81/57.16, 57.17, 57.18, 57.34

(56) References Cited

U.S. PATENT DOCUMENTS

| | | | | |
|---|---|---|---|---|
| 3,906,820 | * | 9/1975 | Hauk | 81/57.15 |
| 4,082,017 | * | 4/1978 | Eckel | 81/57.16 |
| 4,604,922 | * | 8/1986 | Soutsos | 81/57.17 |
| 4,774,861 | * | 10/1988 | Hamilton et al. | 81/57.33 |
| 5,660,087 | * | 8/1997 | Rae | 81/57.2 |
| 6,065,372 | * | 5/2000 | Rauch | 81/57.15 |

FOREIGN PATENT DOCUMENTS

| | | | | |
|---|---|---|---|---|
| 778287 | * | 2/1968 | (CA) | 166/77.5 |
| 1063-980A | * | 12/1983 | (SU) | 166/77.5 |

* cited by examiner

*Primary Examiner*—Frank S. Tsay
(74) *Attorney, Agent, or Firm*—Harrison & Egbert

(57) ABSTRACT

A roller for use in a spinner apparatus for installing a pipe segment in a well pipe including a core member having a central aperture, and a plurality of annular members arranged in stacked relation over the core member. The plurality of annular members are secured together. The core member includes a generally tubular section having a first end and a second end, and a flange section extending radially outwardly of the tubular section between the first and second ends. The flange section has a greater diameter than the tubular section. The flange section includes a plurality of holes formed therein. Each of the annular members has a plurality of holes formed therein. The holes of the annular member are aligned with the holes of the flange section. Fasteners extending through the holes in the flange section and the plurality of annular members. A first cap member is positioned at one end of the plurality of annular members. A second cap member is positioned at the opposite end of the plurality of annular members. The fasteners extends through these cap members and the annular members so as to maintain the annular members together in stacked relationship. Each of the annular members is formed of either an elastomer or a molded organic material. Each of the annular members is formed of split annular members fitted together around the core member.

20 Claims, 6 Drawing Sheets

ROLLER FOR USE IN A SPINNER APPARATUS

TECHNICAL FIELD

The present invention relates to an apparatus for the installation of pipe segments into a well pipe. More particularly, the present invention relates to spinners that are used to thread an end of the pipe segment into an end of the well pipe. Furthermore, the present invention relates to rollers which are used on such a spinner apparatus.

BACKGROUND ART

As used herein, the terms "pipe segments" and "well pipes" can be used to refer severally to drill pipes, drill collars, casings, production tubing, and the like such as may be used in drilling and production operations.

In such operations, lengths of individual downhole tubulars are connected in order to make a string of downhole tubulars necessary for the particular application. The connection of lengths of downhole tubulars to make a string is referred to as "making up" and the disconnection of a string is referred to as "breaking down". The equipment for making up and breaking down a string of downhole tubulars is located on the surface adjacent to the drill hole typically on a drilling floor.

The making up of a string of pipe segments for the purpose of making the well pipe requires the lifting and aligning of an individual length of pipe segment to be added to another pipe segment. Typically, this means that the length of pipe segment to be added is suspended over, aligned and then connected to the well pipe (which may be part of a string of downhole tubulars which may be partially beneath the surface of the earth). The pipe segment to be added may be connected to the well pipe already in place by threading the two of them together either directly or with a coupling. This making up operation necessarily requires that the pipe segment be added must be centered and rotated with respect to the well pipe while the pipe segment is suspended.

Typically, several different diameters of pipe segments are used on such an operation. For example, a production tube may be two and seven-eighths inches in diameter, a drill pipe may be three to twelve inches in diameter, and a casing may be up to thirty-two inches in diameter. As explained above, with respect to each of these different types and different diameters, it is necessary to center the pipe segment and rotate it in order to make up a string. Accordingly, although the centering and rotating may be done by separate devices, it is more efficient if one device could be provided that is able to both center and rotate the variety of pipe segments.

In the past, various patents have issued relating to such a spinning apparatus. For example, U.S. Pat. No. 3,799,009, issued on Mar. 26, 1974 to W. Guier, teaches an apparatus for threading and unthreading vertical lengths of drill pipe. This apparatus includes a backup tong removably positioned around a lower drill pipe, a spinner removably positioned around an upper drill pipe, and a lead tong removably positioned around the upper drill pipe. A piston-and-cylinder arrangement is provided so as to pivot several arms so that a clamping operation can occur for the purposes of the backup tong. Another hydraulic cylinder is mounted on a frame so as to actuate several levers so as to place a chain around the exterior of the drill pipe for the purpose of spinning the drill pipe. Unfortunately, this device has no centralization effect and does not reach so as to draw the drill pipe into a central area. This device can only be used on a single diameter of pipe and must be adapted to the various other diameters of pipe which are to be installed in the well.

U.S. Pat. No. 4,005,621, issued on Feb. 1, 1977, to Turner, Jr. et al., teaches a drilling tong having an open head portion and means for adjustably engaging the peripheral portions of workpieces. The drilling tong has an open area into which the drill pipe is inserted. A hydraulic cylinder, mounted on the tong, can actuate several arms and linkages so as to close the clamping elements onto the exterior surface of the pipe. A spring is used to open the jaw. This device lacks a centralizing effect and does not include the mechanism for spinning the pipe. Since the device utilizes teeth on each of the clamping areas, the teeth may actually support the pipe in an undesired position rather than a centralized position.

U.S. Pat. No. 4,446,761, issued on May 8, 1984 to Boyadjieff et al., teaches a pipe spinning tool having two body parts carrying rollers adapted to engage a pipe at different locations around its periphery and to grip and spin the pipe by rotating one or more of the rollers. The two body parts are mounted by pivotal connections for swinging movement about two spaced axes respectively to grip and release the pipe. An adjustable connection attaches the two pivotal connections together for relative lateral adjusting movements to shift their pivotal axes toward and away from one another for gripping different sizes of pipes. This device is a commonly known spinner used in the commercial market. It does not have a centralizing effect. As such, in order to properly center the drilling pipe in a desired location, the frame of the mechanism must be moved backward and forward and the drill pipe must be centered above the well pipe. Additionally, manual efforts are required to place the pipe segment between the rollers.

U.S. Pat. No. 5,054,550, issued on Oct. 8, 1991 to L. R. Hodge, teaches a centering spinner for centering and spinning downhole tubulars having a range of diameters. The centering spinner includes a frame capable of admitting a downhole tubular therein and a plurality of roller assemblies pivotally coupled to the frame to converge upon and center the downhole tubular. Adjacent rollers of the roller assemblies of the centering spinner are axially displaced with respect to a downhole tubular retained therein. Although this device is designed for centering, it can only center within a limited area. There is no mechanism for drawing the pipe into the spinning area. If the pipe is too deep within the receiving area, the spinning rollers cannot reach it.

U.S. Pat. No. 5,000,065, issued on Mar. 19, 1991, to C. W. Haynes, describes a jaw assembly for gripping pipes such that the jaws cooperate so as to center the pipe. U.S. Pat. No. 5,778,742, issued on Jul. 14, 1998, to R. L. Stuart, describes a hydraulic backup tong assembly which provides for the gripping of the drill pipe. U.S. Pat. No. 5,791,206, issued on Aug. 11, 1998, to Daigle et al., teaches a wrench for making drill pipe segments. The wrench is arranged so as to center the gripping jaws upon the drill pipe.

The rollers which are used with prior art spinner apparatus have a number of problems. Typically, these rollers are formed of a steel material which will contact the pipe in compressive relationship so as to properly rotate the pipe. Unfortunately, the steel rollers are relatively expensive. The hard material which forms the steel rollers can often damage a pipe segment during the compressive contacting of the steel roller with the pipe. If the roller is sufficiently damaged, then it must be entirely replaced and a new roller installed. The steel rollers are difficult to manufacture. Also, steel rollers commonly will have a smooth outer surface. When the pipe has oil or other friction-reducing materials thereon, it is often difficult to achieve a strong frictional contact between steel rollers and the outer surface of the pipe segment.

There are other problems associated with the use of aluminum rollers. These aluminum rollers will wear more quickly than the steel rollers. The edges will tend to fray after continuous use of such aluminum rollers. Because of the rapid wearing of the outer surface of such aluminum rollers, replacement of the rollers must be carried out relatively frequently. In view of the high cost associated with the installation of such pipe segments, any down time associated with the repair of such aluminum rollers could adversely affect the cost of the well. Aluminum rollers are also susceptible at low friction contact with a pipe segment when the pipe segment is covered with oil or a lubricating material. When an aluminum roller must be replaced, the entire roller must be replaced and a new roller installed thereon.

It is another object of the present invention to provide a roller for a spinner apparatus which establishes a strong frictional contact between the outer surface of the roller and the surface of the pipe segment.

It is an object of the present invention to provide a roller for a spinner apparatus which can be easily repaired.

It is another object of the present invention to provide a roller which resists wearing and avoids the fraying of the outermost edges.

It is another object of the present invention to provide a roller for a spinner apparatus which is relatively inexpensive.

It is still a further object of the present invention to provide a roller for a spinner apparatus which will work effectively in an oil or lubricant-filled environment.

It is still a object of the present invention to provide a roller for a spinner apparatus which avoids steel-to-steel contact with the pipe segment.

It is still a further object of the present invention to provide a roller for a spinner apparatus which avoids damage to the pipe segment.

These and other objects and advantages of the present invention will become apparent from a reading of the attached specification and appended claims.

SUMMARY OF THE INVENTION

The present invention is a roller for use in a spinner apparatus comprising a core member having a central aperture, and a plurality of annular members arranged in stacked relationship over the core member. The plurality of annular members are secured together. As used herein and in the claims, the term "annular members" can refer to completely annular members, partially annular members joined together to form an annular member or members having a circular exterior but an interior of non-circular interior configuration.

The core member comprises a generally tubular section having a first end and a second end. A flange section extends radially outwardly of the tubular section between the first and second ends. The flange section has a greater diameter than the tubular section. The flange section and the plurality of annular members have holes formed therein and aligned together. A plurality of fasteners will extend through the respective holes in the flange section and the plurality of annular members so as to affix the plurality of annular members together in stacked relationship. These plurality of fasteners comprise bolts extending through respective holes in the annular members and through the flange section.

The flange section has a diameter no greater than a diameter of one of the annular members. The flange section is integrally connected to the tubular section. The flange section is formed generally centrally between the first and second ends.

The present invention also includes a first cap member which is positioned at one end of the plurality of annular members, a second cap member positioned at an opposite end of the plurality of annular members, and a fastener extending through the cap members and the annular members so as to secure the annular members together in stacked relationship. Each of the cap members is of an annular shape (or partially annular shape joined together) and is formed of a material different than the annular members. The cap members each have a diameter no greater than a diameter of the plurality of annular members. In particular, in the preferred embodiment of the present invention, the core member is formed of steel. The annular members are formed of either an elastomer or a molded organic material. The cap members are each formed of a soft metal, such as aluminum. Each of the cap members has a beveled outer surface tapering outwardly from a respective end of the core member toward an adjacent annular member. Each of the cap members has holes formed therein which are aligned with the holes in the annular members and the flange section. A bolt extends through each of aligned holes. The bolt has a head with a diameter greater than the hole in the cap member. The bolt also has a thread at an end opposite the head. A nut is secured to the thread. The nut will have a diameter greater than the respective diameter of the hole into which the bolt extends. The head of the bolt and the nut serve to sandwich the cap members and the annular members therebetween.

Each of the annular members is a doughnut-shaped member. In the preferred embodiments of the present invention, each of the annular members is comprised of separate halves that can be joined together around the core member. Each of the annular member sections has holes which correspond in location to the holes formed in the cap members. The holes in the annular members can be elongated so as to open to the interior of the annular member. This allows each of the sections to be slide outwardly of the stacked arrangement by a loosening of the half.

In one form of the present invention, each of the cap members includes a suitable recess. The recess in one of the cap members will receive the head of the bolt therein. The recess in the other cap member will receive the nut therein.

The core member has a central aperture which receives the drive shaft of a motor. The core member is engaged with the shaft such that a rotation of the drive shaft causes a rotation of the core member and the annular members.

DETAILED DESCRIPTION OF THE INVENTION

Figure 1:
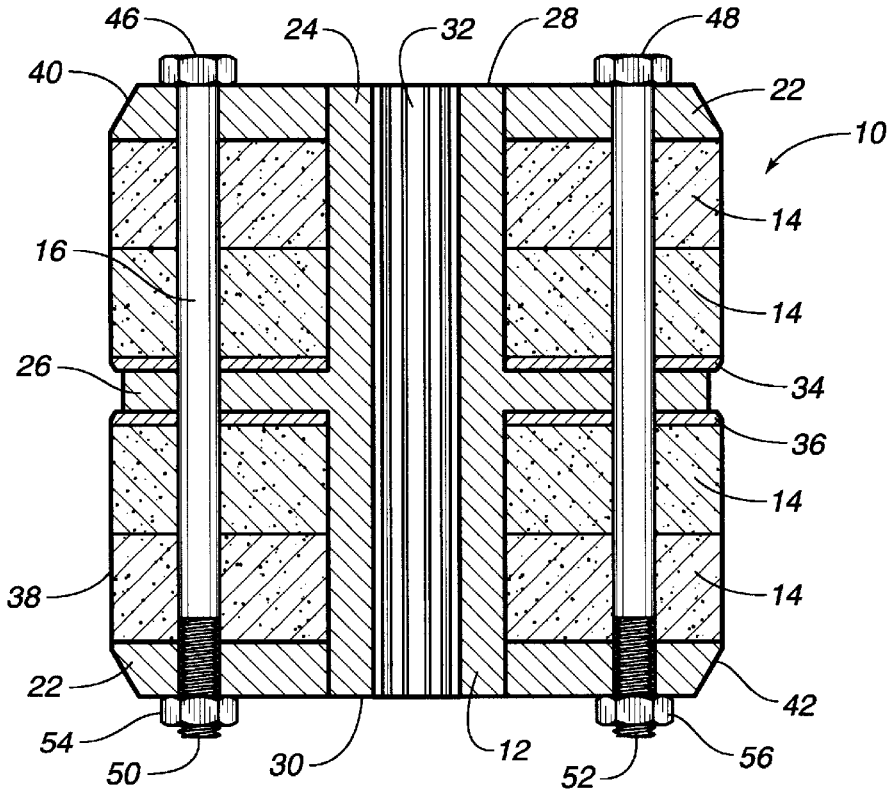
FIG. 1 is a cross-sectional view showing the roller in accordance with the teachings of the preferred embodiment of the present invention.

Referring to FIG. 1, there is shown the roller 10 for use in a spinner apparatus. The roller 10 includes a core member 12 and a plurality of annular members 14 arranged in stacked relationship over the core member 12. Fasteners 16 and 18 are provided so as to secure the annular members 14 together. A first cap member 20 and a second cap member 22 are positioned at the ends of the roller 10 and are secured by the fasteners 16 and 18 so as to sandwich the annular members 14 therebetween.

In the present invention, the core member 12 includes a generally tubular section 24 and a flange section 26. The tubular section 24 has a first end 28 and a second end 30. A central aperture 32 extends through the interior of the tubular section 24. The central aperture 32 is adapted so as to be connected to the drive shaft of a motor or a free shaft. The central aperture 32 of the core member 12 can have keyways or splines formed therein. The tubular section 24 with its central aperture 32 are configured such that the core member 12 will rotate with the rotation of the drive shaft or will rotate over or along with a free shaft (as an idler roller).

The flange section 26 extends radially outwardly of the tubular section 24. The flange section 26 is located generally centrally between the first end 28 and the second end 30 of the tubular section 24. The flange section 26 is, preferably, integrally formed with the core member 24. It can be seen that the flange section 26 has an outer diameter which is less than the outer diameter of the annular members 14 or the cap members 20 and 22. Washer elements 34 and 36 are interposed between the flange section 26 and the adjacent annular members 14. The washer elements 34 and 36 are annular disks which are, preferably, formed of a soft metal material, such as aluminum. The washer elements 34 and 36 will have an outer diameter which is generally equal to the outer diameter of the annular members 14.

The annular members 14 define an outer surface 38. Outer surface 38 will serve to contact a pipe segment when the roller 10 is used in a spinner apparatus. The outer surface 38 will be suitable for high friction contact with the outer surface of the pipe segment. Each of the annular members 14 can be formed of an elastomer. However, preferably, each of the annular members 14 will be formed of a molded non-asbestos organic material. Such organic material is presently manufactured by Motion Control Industries, Inc. of Logansport, Ind. Typically, such a molded non-asbestos organic material is commonly used for clutches and brakes of motor vehicles. This material is die-molded. It is formed of a rigid friction material bound by special resins and rubber with fine steelwool and brass fibers. Since the molded organic material is commonly used, in the past, in association with clutches and brakes of motor vehicles, it is particularly useful in oil or lubricant filled environments. Even if the pipe segment is covered with oil, the outer surface 38 of the roller 10 will have a strong frictional contact with the pipe segment. Unlike the prior art, the use of such molded organic material minimizes slippage of contact between the outer surface 38 and the pipe segment.

For assembly, each of the annular members 14 will slide over the outer diameter of the tubular section 24 until one of the annular members 14 will contact the washer 34. Another of the annular members 14 will slide over the tubular section 24 from end 30 until it contacts the washer element 36. In FIG. 1, four such annular members 14 are illustrated. Within the concept of the present invention, any number of annular members 14 can be used, as required. Also, within the concept of the present invention, each of the annular members can have a split annular configuration, such as illustrated in FIGS. 11A–J.

The first cap member 20 is positioned adjacent to the end 28 of the tubular section 24. The cap member 20 has an annular shape with a beveled outer surface 40. The beveled outer surface 40 will taper outwardly from the end 28 to the adjacent annular member 14. The outer diameter of the first cap member 20 will generally match the outer diameter of the annular members 14. Similarly, the second cap member 22 will have a beveled outer surface 42 which tapers outwardly from the end 30 toward the adjacent annular members 14. The beveled surfaces 40 and 42 will suitably secure the annular members 14 in their sandwiched relationship therebetween. Additionally, when the annular members 14 become worn, the outermost edge of the beveled surfaces 40 and 42 will contact the pipe segments. The use of cap members 20 and 22 and their outwardly beveled edges will protect against fraying of the edges of the outermost annular members. Since the cap members 20 and 22 are preferably formed of an aluminum material, the outermost edges of the cap members 20 and 22 will wear quickly so as to be flush with the outermost diameter of the annular members 14. Since the cap members 20 and 22 are formed of an aluminum material (which is relatively soft), they will not damage the pipe segment even in direct surface-to-surface contact therewith. The washer elements 34 and 36 will protect against the fraying of the edges of the innermost annular members.

In FIG. 1, it can be seen that the fastener 16 extends through holes formed in the first cap member 20, the plurality of annular members 14, the washer elements 34 and 36 and the second cap member 22. Another fastener 18 will extend through other holes in each of the first cap member 20, the plurality of annular members 14, the washer elements 34 and 36, the flange section 26 and the second cap member 22. The fasteners 16 and 18 are bolts which have respective heads 46 and 48 positioned on end 28 against the first cap member 20. The shanks of the respective fasteners 16 and 18 extend through the interior of the roller 10 in the manner described herein previously. The fastener 16 has a threaded area 50 formed at an end extending outwardly of the second cap member 22. The fastener 44 has a threaded end 52 extending outwardly at end 30 from the second cap member 22. A nut 54 is threadedly secured over the threaded end 50 of the fastener 16. A nut 56 is threadedly secured over the threaded end 52. The rotation of the nuts 54 and 56 will cause the cap members 20 and 22 to compressively sandwich the annular members 14 together.

It is important to note, as can be seen in FIG. 1, that repair and replacement of the roller 10 can be carried out in a relatively easy manner. If the annular members 14 should become sufficiently worn or damaged, they can be easily replaced by simply removing the respective nuts 54 and 56 from the threaded ends 50 and 52 and pulling the fasteners 16 and 14 out of the roller 10. This will cause the roller 10 to become disassembled. As such, new annular members can be easily installed. Assembly and disassembly of the roller 10 is made even easier when split annular members (as shown in FIGS. 11A–J) are used in the roller 10.

The core member 12 is formed of a rigid steel material. Since the flange section 26 has a lesser diameter than the diameter of the annular members 14, it will not become damaged from wear to the annular members 14. The core member 12 will remain intact despite any damage or wear which would occur to the outer surface 38. As such, during any repair operation, it will not be necessary to replace the core member 12. The central aperture 32 is always configured so as to properly mate with the shaft of the motor or with an associated free shaft. As a result, no further machining will ever be necessary to the central aperture 32 during replacement or repair. If either of the cap members 20 or 22 should become damaged, then they can simply be replaced. Since each of the cap members 20 and 22 has an identical configuration, it is only necessary to manufacture the cap members of a single form.

Figure 2:
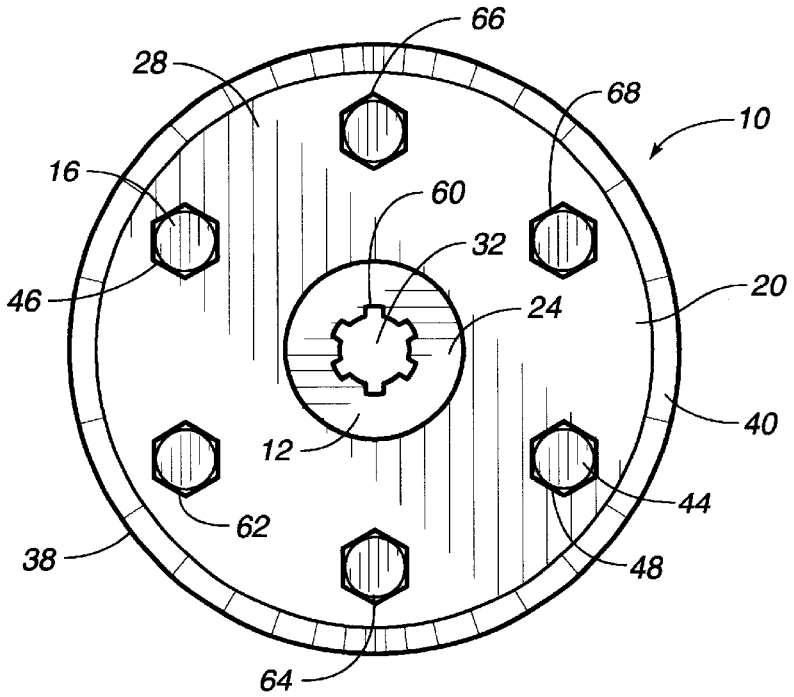
FIG. 2 is a section and plan view of the roller.

FIG. 2 shows a plan view of the roller 10 at end 28. As can be seen, the first cap member 20 has a circumferential beveled edge 40. The core member 12 has tubular section 24 with central aperture 32 formed therein. The central aperture 32 is shown, in FIG. 2, with machined splines 60. These splines 60 will engage with mating splines formed on the shaft of the motor. Fasteners 16 and 18 are illustrated as having their respective heads 46 and 48 positioned on the end 28. Various other fasteners 62, 64, 66 and 68 are illustrated as extending through the roller 10. The outer edge of the beveled section 40 of the first cap member 20 is shown as being flush with the outer surface 38 of the annular members 14.

Figure 3:
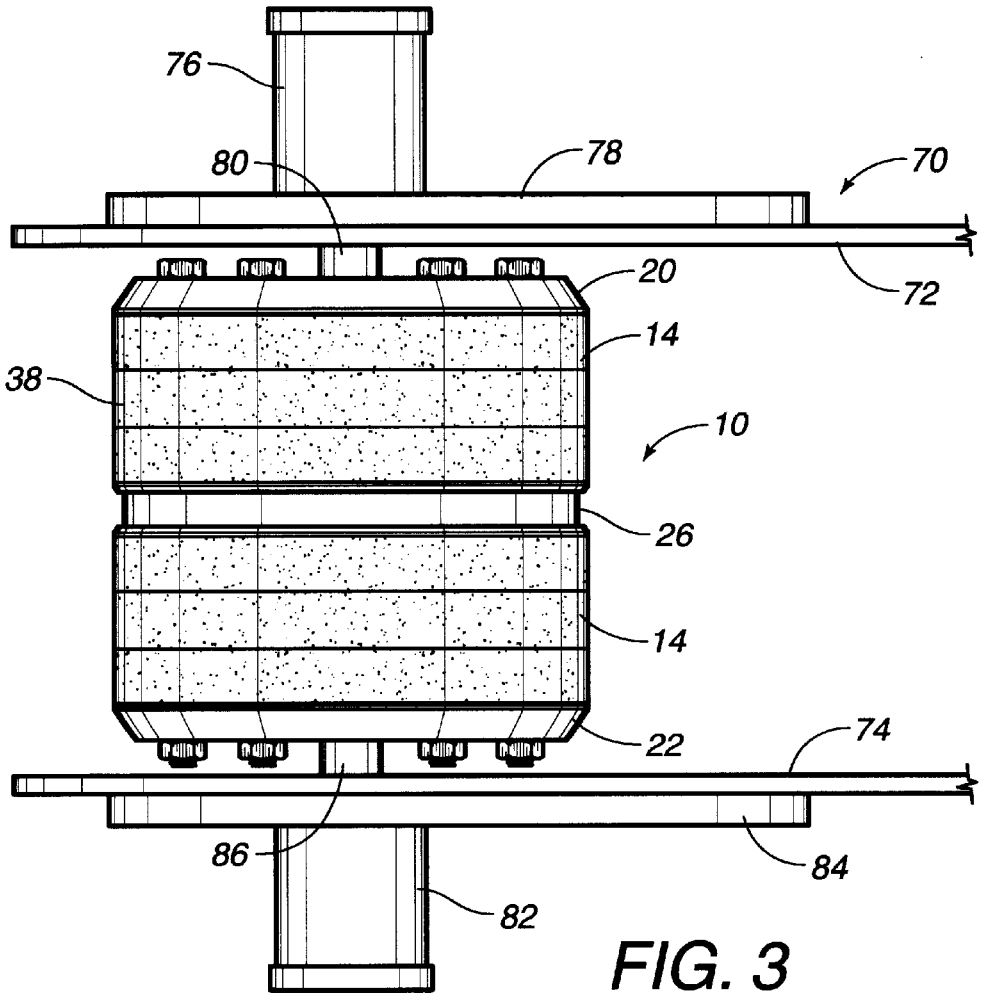
FIG. 3 is a side elevational view showing the roller as installed on an arm of the spinner apparatus.

FIG. 3 shows the roller 10 as installed on the spinner apparatus 70. In particular, spinner apparatus 10 includes arms 72 and 74 extending outwardly. A motor 76 is mounted on a frame 78 on a top surface of the arm 72. The motor 76 has a shaft 80 extending through the arm 72 and into the central aperture 32 of the roller 10. A motor 82 is mounted on frame 84 affixed to the bottom surface of the second arm 74. Shaft 80 is connected to the shaft 86 associated with motor 82. Motors 76 and 82 will correspondingly drive and rotate the roller 10.

In FIG. 3, it can be seen that the roller 10 includes several annular members 14 sandwiched between the cap member 20 and the cap member 22. The flange section 26 is shown as located centrally amongst the annular members 14. The outer surface 38 of the annular members 14 is shown as being in a proper position for contacting a pipe segment and for drivingly rotating such a pipe segment.

Figure 4:
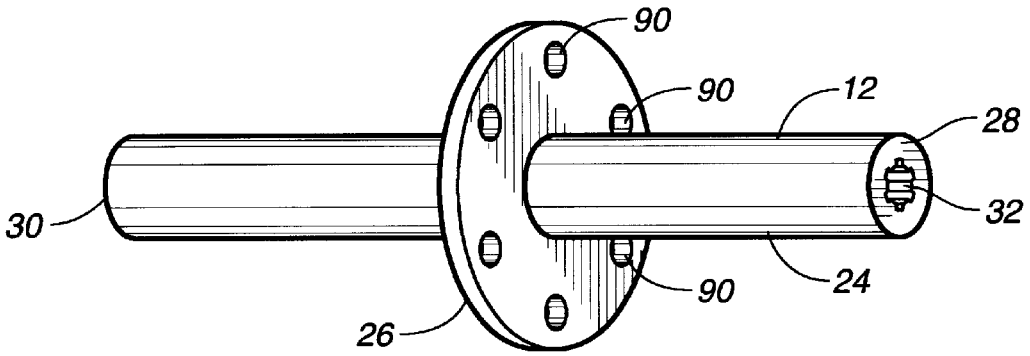
FIG. 4 is an isolated view of the core member of the roller of the present invention.

FIG. 4 is an isolated view of the core member 12. The core member 12 includes a tubular section 24 having a central aperture 32 extending therethrough. Flange section 26 is shown as extending outwardly from the tubular section 24 generally centrally between end 28 and end 30. The flange section 26 has a plurality of holes 90 extending therethrough. Holes 90 will become aligned with respective holes in the annular members 14, with respective holes in the washer elements 34 and 36, and with respective holes in the cap members 20 and 22.

Figure 5:
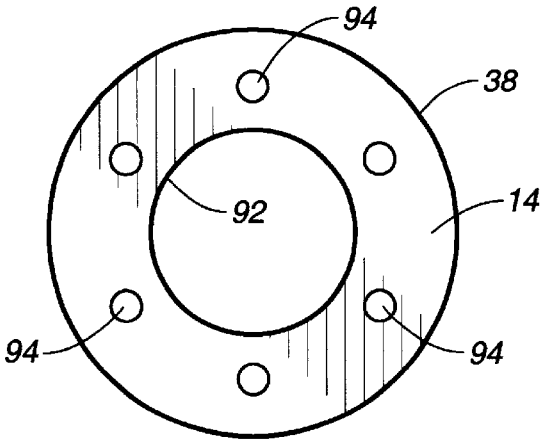
FIG. 5 is a plan view of a simple embodiment of the annular member of the roller of the present invention.

FIG. 5 is an isolated simplified view of a single annular member 14. The preferred form of the annular members is shown in FIGS. 11A–11J. Annular member 14 includes central opening 92 which is of a size suitable for extending over the outer surface of the tubular section 24 of the core member 12. A plurality of smaller holes 94 extend through the annular member 14. The holes 94 are arranged so as to correspond to and align with the holes 90 on the flange section 26. Holes 94 can simply be formed by drilling through the material of the annular member 14. The annular member 14 also has outer surface 38 which is adapted to contact a pipe segment there against.

Figure 6:
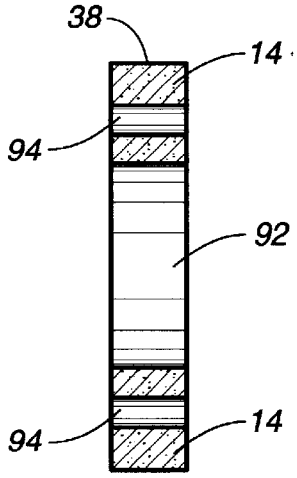
FIG. 6 is a cross-sectional view of the annular member of FIG. 5.

FIG. 6 is a cross-sectional view of the annular member 14 as shown in FIG. 5. Central opening 92 will extend entirely through the body of the annular member 14. Holes 94 are also formed entirely through the body of the annular member 14. Outer surface 38 is on the periphery of the annular member 14.

Figure 7:
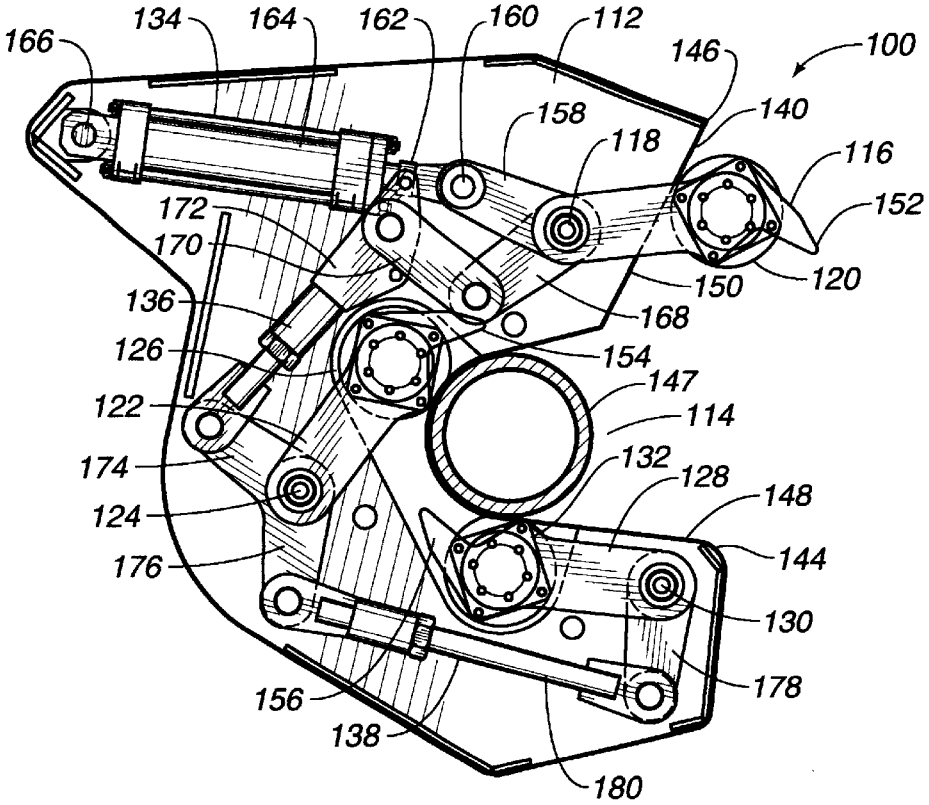
FIG. 7 is a plan view showing the spinner apparatus on which the rollers can be used.

Referring to FIG. 7, a spinner apparatus 100 in accordance with the teachings of the present invention is particularly illustrated. The spinner apparatus 100 will include various rollers in accordance with the teachings of the present invention. The spinner apparatus 100 includes a frame 112 having a reach area 114 formed therein. A first arm 116 is pivotally connected at 118 to the frame 112. A first roller 120 is rotatably connected to the first arm 116. A second arm 122 is pivotally connected at 124 to the frame 112. A second roller 126 is rotatably connected to the second arm 122. A third arm 128 is pivotally connected to the frame 112 at pivot point 130. A third roller 132 is rotatably connected to the third arm 128. An actuator 134 is linked to the first arm 116. The first arm 116 is connected by a linkage 136 to the second arm 122. Similarly, the second arm 122 is connected by synchronization linkage 138 to the third arm 128. The actuator 134 is adapted to pivot the first arm 116 such that the roller 120 will move toward the reach area 114. At the same time, the linkages 136 and 138 will cause the roller 126 on the second arm 122 and the roller 132 on the third arm 128 to move in a coordinated manner toward the reach area 114.

The reach area 114 is a generally U-shaped indentation which extends inwardly from the outer edge 140 of the frame 112. The outer limit of the reach area 114 will actually extend outwardly of the opening formed between the comer 144 and the comer 146 of the frame 112. This reach area is indicative of the reach of the arms of the spinner apparatus 10 for the receipt of a pipe segment 147 therein. The walls 148 and 150 have a "funnel" shape so as to urge the pipe segment 147 to its desired centralized position.

In FIG. 7, it can be seen that the first arm 116 includes a claw member 152 which extends outwardly from a side of the first roller 120 opposite the pivot point 118. It can be seen that the claw 152 extends outwardly beyond the outer diameter of the first roller 120. The claw member 152 will serve to draw the pipe segment 147 into the interior of the reach area 114 within the frame 112. The second arm 122 includes a claw member 154 which extends outwardly from a side of the second roller 126 opposite the pivot point 124. This claw member 154 will cause the pipe segment 147 to move toward its desired position within the reach area 114. Additionally, the third arm 128 includes a claw member 156 which extends outwardly beyond the outer diameter of the third roller 132 on a side opposite the pivot point 130. The claw members 152, 154 and 156 will interact so as to place the pipe segment 147 into its desired centralized position and to place the pipe segment between the outer surfaces of the rollers 120, 126 and 132.

The first arm 116 has a lever 158 which is pivotally connected at 160 to the piston 162 associated with the hydraulic cylinder 164 of the actuator 134. The hydraulic cylinder 164 is pivotally connected at 166 to the frame 112. The first arm 116 also has a link arm 168 connected to the linkage 136 to the second arm 122. The lever 158 and the link arm 168 extend outwardly from the first arm 116 on a side of the point of pivotal connection 118 of the first arm 116 with the frame 112. The linkage 136 includes a link member 170 which is pivotally connected to the link arm 168 of the first arm 116. The linkage 136 also includes a pull rod arm 172 which is pivotally connected to an end of the link member 170 opposite the link arm 168. The pull rod arm 172 has an opposite end pivotally connected to the second arm 122 at an end of the second arm 122 opposite the second roller 126.

The second arm 122 has a lever 174 connected to the end of the pull rod arm 172 opposite the link member 170. The second arm 122 also has a link arm 176 which is connected by synchronization linkage 138 to the third arm 128. The lever 174 and the link arm 176 of the second arm 122 extend from a side of the point of pivotal connection 124 of the second arm 122 opposite the roller 126.

The third arm 128 includes a pull rod 178 extending outwardly from a side of the point of pivotal connection 130 of the third arm 128 with the frame 112 opposite the third roller 132. The pull rod 178 is connected to one end of the synchronization linkage 138. The synchronization linkage 138 includes a synchronization lever 180 having one end pivotally connected to the pull rod 178 of the third arm 128 and an opposite end pivotally connected to the link arm 176 of the second arm space 122.

In FIG. 7, each of the rollers 120, 126 and 132 have a configuration similar to the roller described in association with the preferred embodiment of the present invention. As can be seen in FIG. 7, rollers 126 and 132 have their outer surfaces in direct frictional contact with the outer surface of the pipe segment 147. The first roller 120 will move into direct contact with the outer surface of the pipe segment 147

Figure 8:
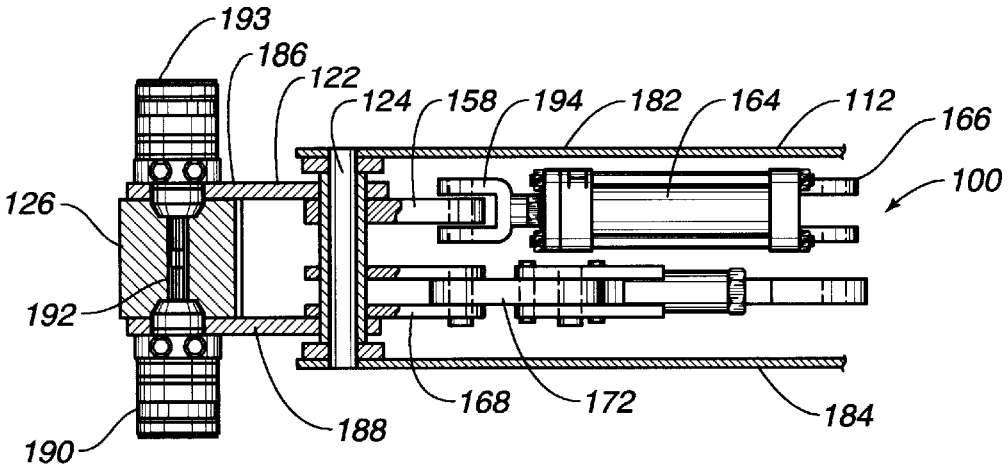
FIG. 8 is a partial side view of the spinner apparatus of FIG. 7.

FIG. 8 shows a side view of the arrangement of the spinner apparatus 100. As can be seen, the frame 112 includes a top side 182 and a bottom side 184. The pivot point 124 is pivotally received between the top side 182 and the bottom side 184. The second arm 122 is illustrated as having a top component 186 and a bottom component 188. The top component 186 and the bottom component 188 serve to receive the roller 126 therebetween. A first hydraulic motor 190 is connected to the roller 126 so as to drivingly rotate the roller 126 in a desired direction. A second hydraulic motor 193 is connected to the shaft 192 of the motor 190 so as to correspondingly drive the roller 126. Roller 126 can have the configuration as shown in the preferred embodiment of the present invention in accordance with FIGS. 1–6.

The motor 190 will drivingly rotate the roller 126 so as to rotate the pipe segment 147 contacting the roller 126. It is possible for separate hydraulic motors to be connected to each of the rollers 120, 126 and 132. Also, it is possible to use two hydromotors or airmotors with each roller. The use of two such motors will eliminate the need for bearings and simplifies maintenance and repair. However, and alternatively, a single motor 190 can be used with any one of the rollers 120, 126 and 132 while the remaining rollers simply act as idler rollers. The motor 190 can be a hydromotor. The shaft 192 of the motor 190 is directly connected to the roller 126. The roller 126 can be suitably mounted in proper bearings associated with the components 186 and 188 of the arm 122.

FIG. 8 also shows the cylinder lever 158 as connected to the hydraulic cylinder 164 by way of a clevis pin 194. The hydraulic cylinder 164 is illustrated as being pivotally connected to the upper frame component 182 at the pivot point 166. The link arm 168 is illustrated as receiving the pull rod arm 172.

The spinner apparatus 100 serves to position the pipe segment 147 such that the longitudinal axis will always be in the identical position within the reach area 114. As such, the pipe segments will always be in longitudinal alignment with the well pipe during the installation procedures.

In FIG. 7, it can be seen that the pipe segment 147 has been positioned within the reach area 114 of the frame 112. The pipe segment 147 is drawn into its desired position within the interior of the reach area 114 between the walls 148 and 150 of the frame 112 by the manipulation of the claw member 152 at the end of the first arm 116. The tip of the claw member 152 will contact a surface of the pipe segment 147 and pull the pipe segment 147 into the reach area 114 and into the opening of the frame 112. In FIG. 7, a relatively large diameter pipe 147 is illustrated. It can be seen that the outer surface of the pipe segment 147 contacts the surfaces of rollers 120, 126 and 132. In this position, the central axis of each of the rollers 120, 126 and 132 will be equally spaced from the central longitudinal axis of the pipe segment 147. Each of the rollers 120,126 and 132 will be equally spaced with respect to each other.

So as to carry out the operation of centralizing the pipe segment 147, the hydraulic cylinder 164 of the actuator 134 is actuated so as to cause the piston rod 162 to move outwardly. This causes a pivoting of the lever 158 about the pivot point 160. Simultaneously, the arm 116 will pivot about the pivot point 118 so as to cause the roller 120 and the claw member 152 to move into the interior of the reach area 114 while pushing the pipe segment 147. Additionally, the link arm 168 will pivot the linkage 136 so as to cause the lever 174 of the second arm 122 to move the roller 126 outwardly so as to contact a surface of the pipe segment 147. Also, and simultaneously, the link arm 176 of the second arm 122 will pull the synchronization lever 180 so as to draw the pull rod lever 178 in a direction such that the third arm 128 will pivot such that the roller 132 contacts the surface of the pipe segment 147. All of this movement occurs coordinatedly with the movement of the actuator 134.

Figure 9:
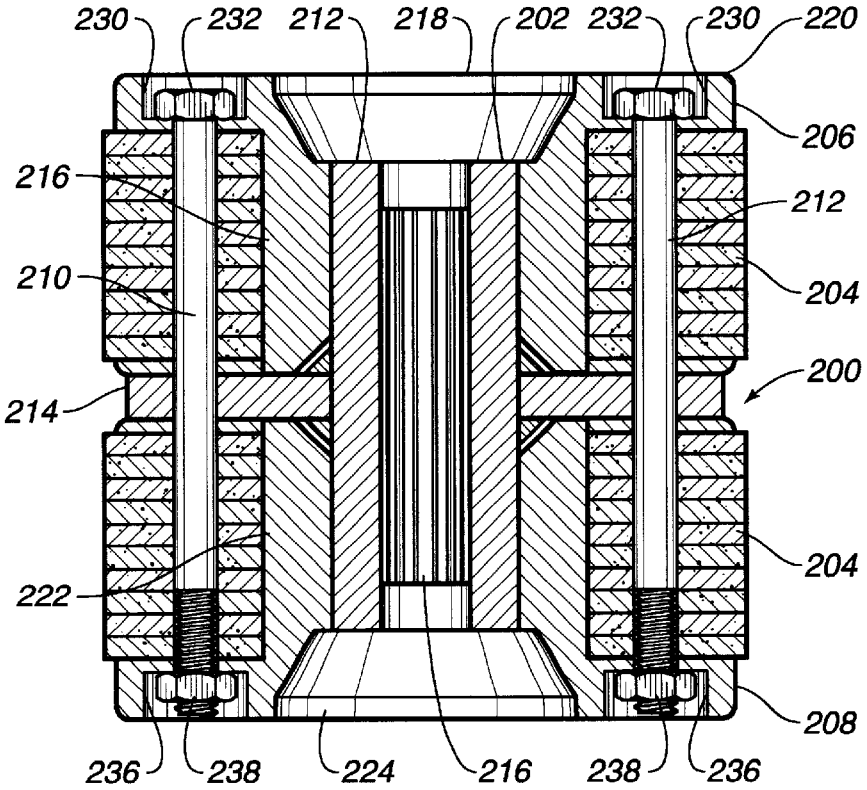
FIG. 9 is a cross-sectional view showing the roller of an alternative embodiment of the present invention.

FIG. 9 shows an alternative embodiment 200 of the roller in accordance with the teachings of the present invention. The roller 200 includes a core member 202 and a plurality of stacked annular members 204. A first core member 206 is positioned on the stacked annular members 204. A second core member 208 is positioned at the bottom of the stacked annular members 204. Fasteners 210 and 212 extend through the annular members 204 and are received within the cap members 206 and 208.

In the roller 200, the core member 202 includes a tubular section 212 having a radially outwardly extending flange section 214. The tubular section 212 has a central aperture 216 extending therethrough.

Unlike the previous embodiment of the present invention, it can be seen that a first sleeve 216 resides over the outer surface of the tubular section 212. The first sleeve 216 has one end contacting a surface of the flange section 214. The sleeve 216 will extend upwardly and will define the opening 218 at the top surface 220 of the cap member 206. A second sleeve 222 is positioned over the tubular section 212 so as to have an end contacting an opposite side of the flange section 214. The bottom of the sleeve 222 will define the opening 224 at the bottom of the roller 200. As can be seen in FIG. 9, the sleeve 222 is integral with the cap member 208. Similarly, the sleeve 216 can be integral with the cap member 206. In this embodiment, the flange section 214 does not have to be integral with the tubular section 212.

So as to facilitate the installation of the roller 200, it can be seen that the first cap member 206 has recesses 230 formed therein. Recesses 230 serve to receive the respective heads 232 and the fasteners 210 and 212. Similarly, recesses 236 are formed in the second cap member 208. The recesses 236 serve to receive respective nuts 238. Nuts 238 are affixed to the threaded ends of the respective fasteners 210 and 212. In the embodiment shown in FIG. 9, neither the heads 232 or the nuts 238 or the fasteners will interfere with the rotation of the roller 200.

In FIG. 9, the annular members 204 will have a configuration similar to that described herein previously except for being of smaller thickness.

Figure 10:
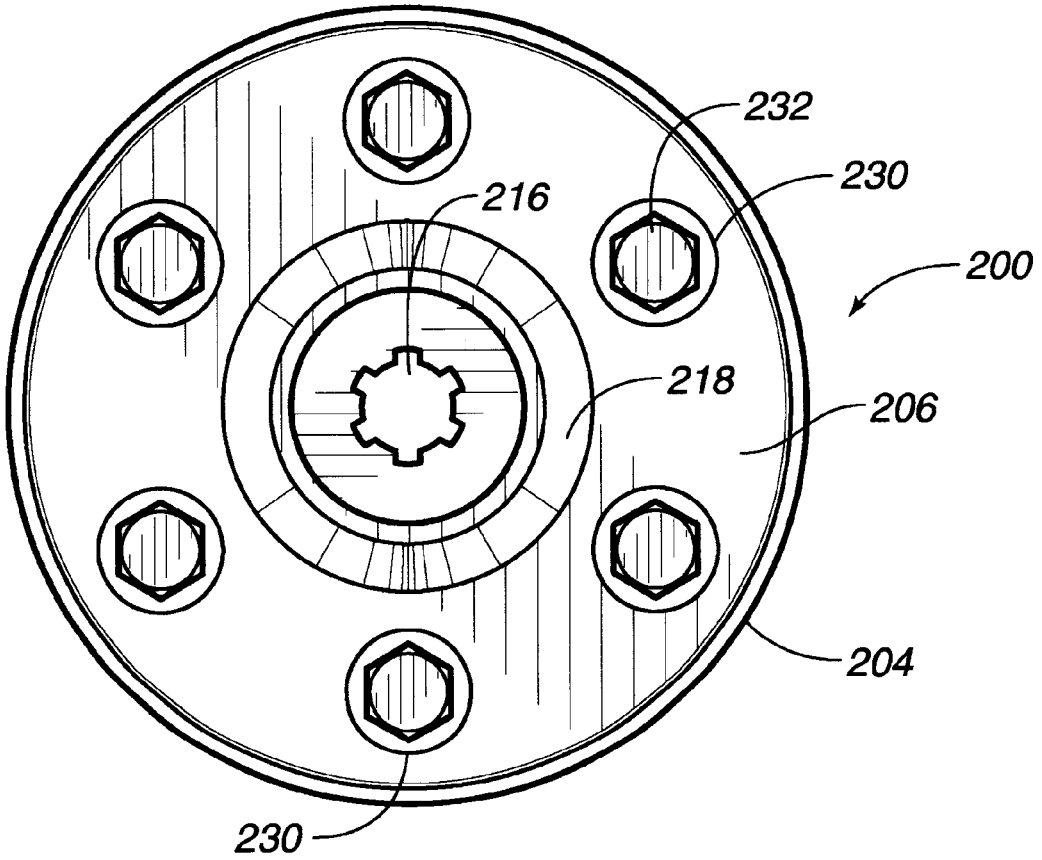
FIG. 10 is a plan view of the roller of the alternative embodiment of FIG. 9.

FIG. 10 is a plan view showing the roller 200. As can be seen, first cap member 206 does not have a tapering outer edge. The outer surface of the plurality of annular members 204 lies outside of the peripheral edge of the cap member 206. Recesses 230 are formed in the cap member 206 at the location of the holes which extend through the annular members 204. As such, the head 232 of a respective fastener will be located interior of the recess 230. The top opening 218 is illustrated as formed centrally of the cap member 206. The central aperture 216 allows the roller 206 to be suitably attached to a supporting shaft.

FIGS. 11A–11J show the various forms of the annular members that can be used with the present invention. It is important to realize that the annular members shown in FIGS. 11A–11J are split annular members which can be assembled interior of the roller apparatus so as to form the desired annular member. After experimentation, it was found that assembly and disassembly of the roller apparatus was made easier through the use of such split annular members. Instead of having to remove the cap members from the top and the bottom of the roller, it was only necessary to loosen the fasteners (the bolts) and slidably remove a split annular member from the stack of annular members. Alternatively, the bolts could be removed and individual split annular members removed and replaced without disassembly of the entire stack. Importantly, the split annular members will remain in place simply by virtue of the fact of the compressive relationship between the exterior surface of the annular members and the outer surface of the drill pipe. If a split annular member happens to be installed within the stack of annular members in a slightly off-center manner, then the compressive relationship between the annular members and the drill pipe will push the off-center split annular member back into its de sired position. If the fasteners are not tightened with enough force, then the compressive relationship between the roller and the drill pipe will maintain the split annular members in their desired position so that they will not come loose from the stacked relationship.

With specific reference to FIGS. 11A–11J, FIG. 11A shows annular member 300 having sides 302 and 304. Central opening 306 is suitable for extending over the core member of the roller assembly. Holes 308 and 310 are formed along g the edge between the sides 302 and 304. Additional holes 312, 314, 316 and 318 are formed through the annular member 300. Each of the holes 312, 314, 316 and 318 comprises a slot which communicates with the interior central opening 306.

Figure 11A:
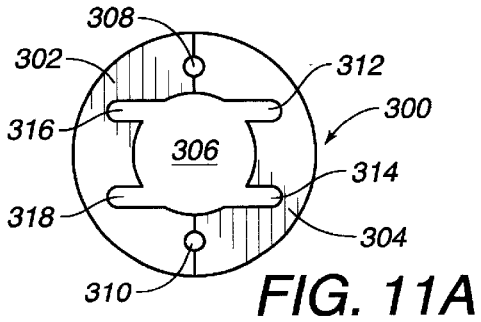
FIGS. 11A–J show various embodiments of the annular member as used in the present invention.
Figure 11B:
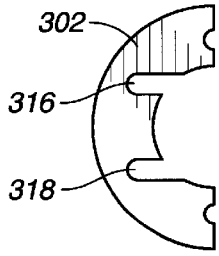
Figure 11B:
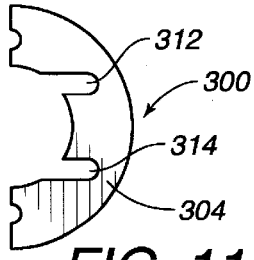

FIG. 11B shows the manner of disassembly of the annular member 300. As can be seen, when the bolts in the roller assembly are suitably loosened, side 302 will separate from side 304. The holes 312 and 314 (along with their associated slots) can simply be pulled and removed from the stacked arrangement of annular members. Similarly, the holes 316 and 318 (along with their associated slots) of side 302 can simply be pulled from the stacked arrangement. One of the sides 302 and 304 can be removed and replaced without the need to disturb the entire stacked arrangement of annular members.

Figure 11C:
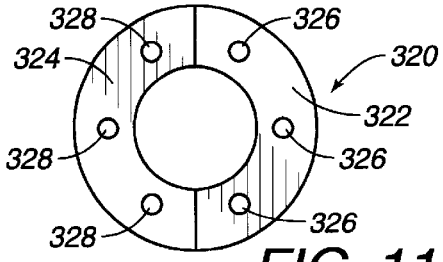

FIG. 11C shows another form of the annular member 320 in accordance with the present invention. Annular member 320 includes sides 322 and 324, each having holes extending therethrough. Annular member 320 is a split annular member. Three holes 326 are formed on side 322. Additionally, three holes 328 are formed on side 324.

Figure 11D:
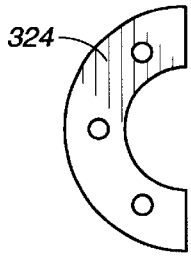
Figure 11D:
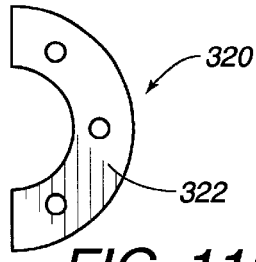

FIG. 11D shows the removal of the annular member 320. Annular member 320 is removed by simply pulling each of the bolts which hold the stacked arrangement together outwardly from the stacked arrangement. The removal of the bolts will allow the separation of side 322 from 324. After repair or replacement is complete, it is only necessary to reinstall the fasteners so as to secure each of the sides 322 and 324 back together in an annular configuration.

Figure 11E:
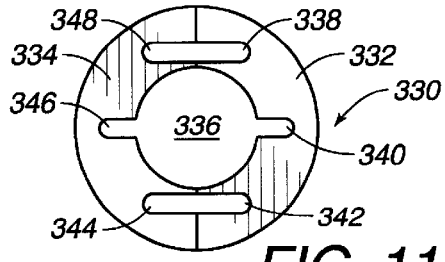

FIG. 11E shows an alternative embodiment of the annular member 330 of the present invention. Annular member 330 includes sides 332 and 334. A central opening 336 is formed interior of the annular member 330. Side 332 includes holes 338, 340 and 342. Side 334 includes holes 344, 346 and 348. The holes 338 and 342 of side 332 communicate respectively with holes 344 and 348 of side 334. Holes 340 and 346 will communicate with the central opening 336.

Figure 11F:
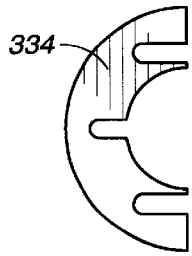
Figure 11F:
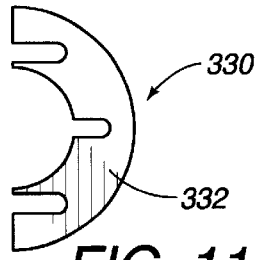

FIG. 11F shows how the sides 332 and 334 of the annular member 330 can be removed and replaced. Removal and replacement is accomplished by simply loosening the bolts which hold the stacked arrangement of annular members together. A specific side 332 or 334 can simply be pulled from the stacked arrangement. There is no need to completely remove the bolts. The elongated holes formed on each of the sides 332 and 334 provides a great deal of adjustability when installing each of the sides 332 and 334 onto the core member.

Figure 11G:
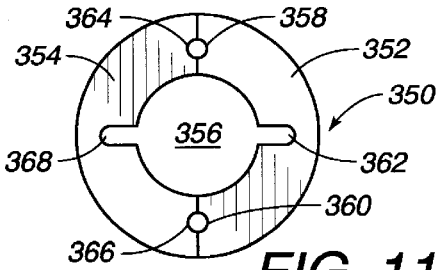
Figure 11H:
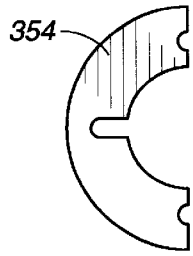
Figure 11H:
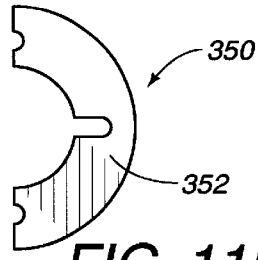

FIG. 11G and FIG. 11H show a simplified embodiment of the annular member 350 in accordance with the present invention. Annular member 350 includes sides 352 and 354 extending around central opening 356. Side 352 includes semi-circular openings 358 and 360 at its edges. A hole 362 opens so as to communicate with the central opening 356 by virtue of a slot. The side 354 will have an identical configuration to side 352 so as to have a semi-circular opening 364 facing semi-circular opening 358 as to form circular hole. The other semi-circular opening 356 will face semi-circular opening 360 so as to form a circular hole. Side 354 also includes a slotted hole 368 extending so as to open n to the central opening 356.

FIG. 11H shows how assembly of the annular member 350 can be accomplished. It is only necessary to loosen the fastening bolts in the stacked arrangement. The sides 352 and 354 can simply be removed by sliding one of the sides from the stacked arrangement.

Figure 11I:
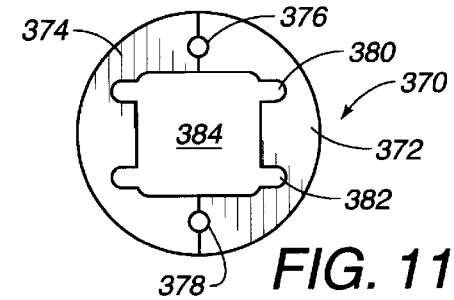
Figure 11J:
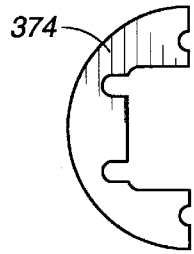
Figure 11J:
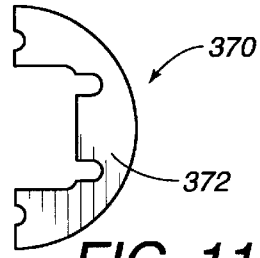

FIGS. 11I and 11J show another simple form of the annular member 370 of the present invention. It is important to note that within the concept of the present invention, the core member does not have to have a circular cross-section. In fact, in order to properly engage the interior of the respective annular member, a multi-sided or rectilinear configuration may be preferable. FIGS. 11I and 11J show such a configuration adapted to be connected to such a multi-sided shaped core member. As can be seen, annular member 370 includes side 372 and side 374. A semi-circular hole 376 is formed on the side 372. Another semi-circular hole 378 is formed on the side 372. Slotted holes 380 and 382 are also provided on side 372 so as to open to the central opening 384. Central opening 384 has a generally square configuration which will mate with a square-shaped core member. The side 374 will have a similar configuration as side 372 so as to properly mate together when assembled in the stacked arrangement. As such, the interior of the sides 372 and 374 will extend around such square-shaped core member. FIG. 11J shows the removal of the annular member 370 by the separation of side 372 from side 374. This can be accomplished by simply loosening the fastening bolts in the stacked arrangement of annular members. Each of the sides 372 and 374 can simply be slidably removed from the stack.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A roller for use in a spinner apparatus comprising:

a core member having a central aperture; and a plurality of annular members arranged in stacked relation over said core member, said plurality of annular members being secured together.

2. The roller of claim 1, said core member comprising:

a generally tubular section having a first end and a second end; and a flange section extending radially outwardly of said tubular section between said first and second ends, said flange section having a greater diameter than said tubular section.

3. The roller of claim 2, said flange section having a plurality of holes formed therein, each of said plurality of annular members having a plurality of holes formed therein, said plurality of holes of said annular member being aligned with said plurality of holes of said flange section.

4. The roller of claim 3, further comprising:

a plurality of fasteners extending through said flange section and said plurality of annular members so as to affix said plurality of annular members together in stacked relationship.

5. The roller of claim 3, said flange section having a diameter no greater than a diameter of one of said plurality of annular members.

6. The roller of claim 1, further comprising:

a first cap member positioned at one end of said plurality of annular members;

a second cap member positioned at an opposite end of said plurality of annular members; and a fastener extending through said first and second cap members and said plurality of annular members so as to secure said plurality of annular members together in stacked relationship.

7. The roller of claim 6, said first and second cap members being of an annular configuration, said first and second cap members being formed of a material different than a material of said plurality of annular members, said first and second cap members each having a diameter no more than a diameter of each of said plurality of annular members.

8. The roller of claim 6, said core member being formed of steel, said plurality of annular members being formed of a material selected from the group consisting of an elastomer and a molded organic, said first and second core members being formed of aluminum.

9. The roller of claim 6, each of said first and second cap members having a beveled outer surface tapering outwardly from a respective end of said core member toward an adjacent annular member of said plurality of annular members.

10. The roller of claim 6, each of said first and second cap members having a plurality of holes formed therein, each of said plurality of annular members having a plurality of holes formed therein, said fastener comprising:

a bolt extending through one of said plurality of holes in each of said first and second cap members, said bolt extending through one of said plurality of holes in each of said plurality of annular members.

11. The roller of claim 1, said central aperture of said core member having a drive shaft of a motor extending therethrough, said core member engaged with said shaft such that a rotation of said drive shaft causes a rotation of said core member and said plurality of annular members.

12. The roller of claim 1, said core member comprising:

a generally tubular section having a first end and a second end;

a flange portion positioned around said tubular section between said first and second ends, said flange portion extending radially outwardly of said tubular section;

a first sleeve extending around said tubular section and having an end abutting one side of said flange portion; and a second sleeve extending around said tubular section and having an end abutting an opposite side of said flange portion.

13. The roller of claim 1, each of said plurality of annular members comprising a first split annular member and a second split annular member joined together around said core member.

14. The roller of claim 13, each of said first and second split annular members having a plurality of holes extending therethrough, at least one of said plurality of holes being slotted so as to open to a side of the split annular member.

15. The roller of claim 13, each of said first and second split annular members having an interior opening positioned in mating relationship around said core member.

16. The roller of claim 1, each of said plurality of annular members having an interior opening positioned around said core member, said core member having a multi-sided non-circular cross-section.

17. An apparatus for installing a pipe segment in a well pipe comprising:

a frame having a reach area formed therein;

a plurality of arms pivotally connected to said frame and linked together;

an actuator linked to at least one of said plurality of arms, said actuator adapted to pivot one of said plurality of arms so as to move at least one of said plurality of arms into said reach area; and a roller rotatably mounted on at least one of said plurality of arms, said roller comprising a core member having a plurality of annular members arranged in stacked relationship on said core member, said plurality of annular members being secured together so as to rotate with said core member.

18. The apparatus of claim 17, said core member comprising:

a generally tubular section having a first end and a second end;

a flange section extending radially outwardly of said tubular section between said first and second ends, said flange section having a greater diameter than said tubular section, said flange section having a plurality of holes formed therein, each of said plurality of annular members having a plurality of holes formed therein, said plurality of holes of said annular member being aligned with said holes of said flange section; and a plurality of fasteners extending through said flange section and through said plurality of annular members so as to affix said plurality of annular members together in stacked relationship.

19. The apparatus of claim 17, further comprising:

a first cap member positioned at one end of said plurality of annular members;

a second cap member positioned at an opposite end of said plurality of annular members; and a fastener extending through said first cap member, said second cap member and said plurality of annular members so as to secure said plurality of annular members together in stacked relationship.

20. The apparatus of claim 17, further comprising:

a motor affixed to the arm on which said roller is rotatably mounted, said motor having a shaft extending through said core members so as to be drivingly connected to said roller.

* * * * *